US009972911B1

(12) United States Patent
Hussain et al.

(10) Patent No.: US 9,972,911 B1
(45) Date of Patent: May 15, 2018

(54) WIDE BAND FREQUENCY AGILE MIMO ANTENNA

(71) Applicant: KING FAHD UNIVERSITY OF PETROLEUM AND MINERALS, Dhahran (SA)

(72) Inventors: Rifaqat Hussain, Dhahran (SA); Mohammad S. Sharawi, Dhahran (SA)

(73) Assignee: KING FAHD UNIVERSITY OF PETROLEUM AND MINERALS, Dhahran (SA)

( * ) Notice: Subject to any disclaimer, the term of this patent is extended or adjusted under 35 U.S.C. 154(b) by 29 days.

(21) Appl. No.: 15/333,157

(22) Filed: Oct. 24, 2016

(51) Int. Cl.

| | |
|---|---|
| ***H01Q 21/06*** | (2006.01) |
| ***H01Q 13/10*** | (2006.01) |
| ***H01Q 21/00*** | (2006.01) |
| ***H01Q 1/38*** | (2006.01) |
| ***H01Q 1/48*** | (2006.01) |

(52) U.S. Cl.
CPC ..... *H01Q 13/106* (2013.01); *H01Q 1/38* (2013.01); *H01Q 1/48* (2013.01); *H01Q 21/00* (2013.01)

(58) Field of Classification Search
CPC ..... H01Q 1/38; H01Q 1/48; H01Q 21/00
USPC ..... 343/700 MS, 702, 749–751, 846, 850
See application file for complete search history.

(56) References Cited

U.S. PATENT DOCUMENTS

| | | | | |
|---|---|---|---|---|
| 8,421,686 | B2 * | 4/2013 | Soler Castany | H01Q 1/2283 257/678 |
| 2007/0229357 | A1 | 10/2007 | Zhang et al. | |
| 2010/0231461 | A1 | 9/2010 | Tran | |
| 2012/0139793 | A1 | 6/2012 | Sharawi | |
| 2014/0159971 | A1 | 6/2014 | Hall et al. | |
| 2015/0263423 | A1 | 9/2015 | Park et al. | |
| 2016/0006116 | A1 | 1/2016 | Sharawi et al. | |
| 2016/0036127 | A1 | 2/2016 | Desclos et al. | |
| 2016/0043477 | A1 | 2/2016 | Montgomery et al. | |

FOREIGN PATENT DOCUMENTS

| | | |
|---|---|---|
| GB | 2500209 A | 9/2013 |

OTHER PUBLICATIONS

Hussain, R., Sharawi, M.S., "A low profile compact reconfigurable MIMO antenna for cognitive radio applications", 2015 9th European Conference on Antennas and Propagation (EuCAP), (May 13-17, 2015).

* cited by examiner

*Primary Examiner* — Dameon E Levi
*Assistant Examiner* — Hasan Islam
(74) *Attorney, Agent, or Firm* — Richard C. Litman

(57) ABSTRACT

The wide band frequency agile MIMO antenna is a 4-element, reconfigurable multi-input multi-output (MIMO) antenna system. Frequency agility in the design is achieved using varactor diodes tuned for various capacitance loadings. The MIMO antennas operate over a wide band, covering several well-known wireless standards between 1610-2710 MHz. The present design is simple in structure with low profile antenna elements. The design is prototyped on commercial plastic material with board dimensions 60×100×0.8 $mm^3$ and is highly suitable to be used in frequency reconfigurable and cognitive radio based wireless handheld devices.

5 Claims, 6 Drawing Sheets

600

700

WIDE BAND FREQUENCY AGILE MIMO ANTENNA

BACKGROUND OF THE INVENTION

1. Field of the Invention

The present invention relates to wideband wireless communication systems, and particularly to a wide band frequency agile MIMO antenna for cognitive radio platforms, compact wireless devices, and LTE mobile handsets.

2. Description of the Related Art

Higher data rates are required in each upcoming wireless communication system generation, and hence are a topic of continuous attention. New trends and standards are continuously adopted to meet this high throughput requirement. New services and applications are continuously being added to bring multimedia and high definition video to user terminals. Existing technologies, such as Long Term Evolution (LTE), broadband LTE services, and 4G commercial services, are implemented in wireless communication devices to meet such demands.

To enhance the capacity of a communication system, it is necessary to implement the multiband or wideband system with reconfigurable characteristics.

Thus, a wide band frequency agile MIMO antenna solving the aforementioned problems is desired.

SUMMARY OF THE INVENTION

The wide band frequency agile MIMO antenna is a 4-element, reconfigurable, multi-input multi-output (MIMO) antenna system. Frequency agility in the design is achieved using varactor diodes tuned for various capacitance loadings. The MIMO antennas operate over a wide band, covering several well-known wireless standards between 1610-2710 MHz. The present design is simple in structure with low profile antenna elements. The design is prototyped on commercial plastic material with board dimensions $60\times100\times0.8$ mm$^3$ and is highly suitable to be used in frequency reconfigurable and cognitive radio-based wireless handheld devices.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The wide band frequency agile MIMO antenna 100 is a 4-element wide band modified monopole reconfigurable MIMO antenna system covering several wireless standard frequency bands. The present design is a frequency reconfigurable MIMO antenna system with reconfigurability being achieved by using varactor diodes. The MIMO antenna system is operable over a wide band, covering several well-known wireless standards between 1610-2710 MHz. This includes GSM-1800/GSM-1900, PCS (1850~1990 MHz) and UMTS (1885-2200 MHz), LTE 1800/1900/2100/2300/2600 MHz bands, along with several other bands. The present design is compact, low profile, and planar in structure so that the antenna can be easily integrated in small wireless handheld devices and mobile terminals with a small form factor. The present design provides enhanced radiation characteristics by optimizing the GND plane to act as a reflector. This improved radiation characteristic enhances MIMO performance by reducing field coupling between various antenna elements.

Figure 1A:
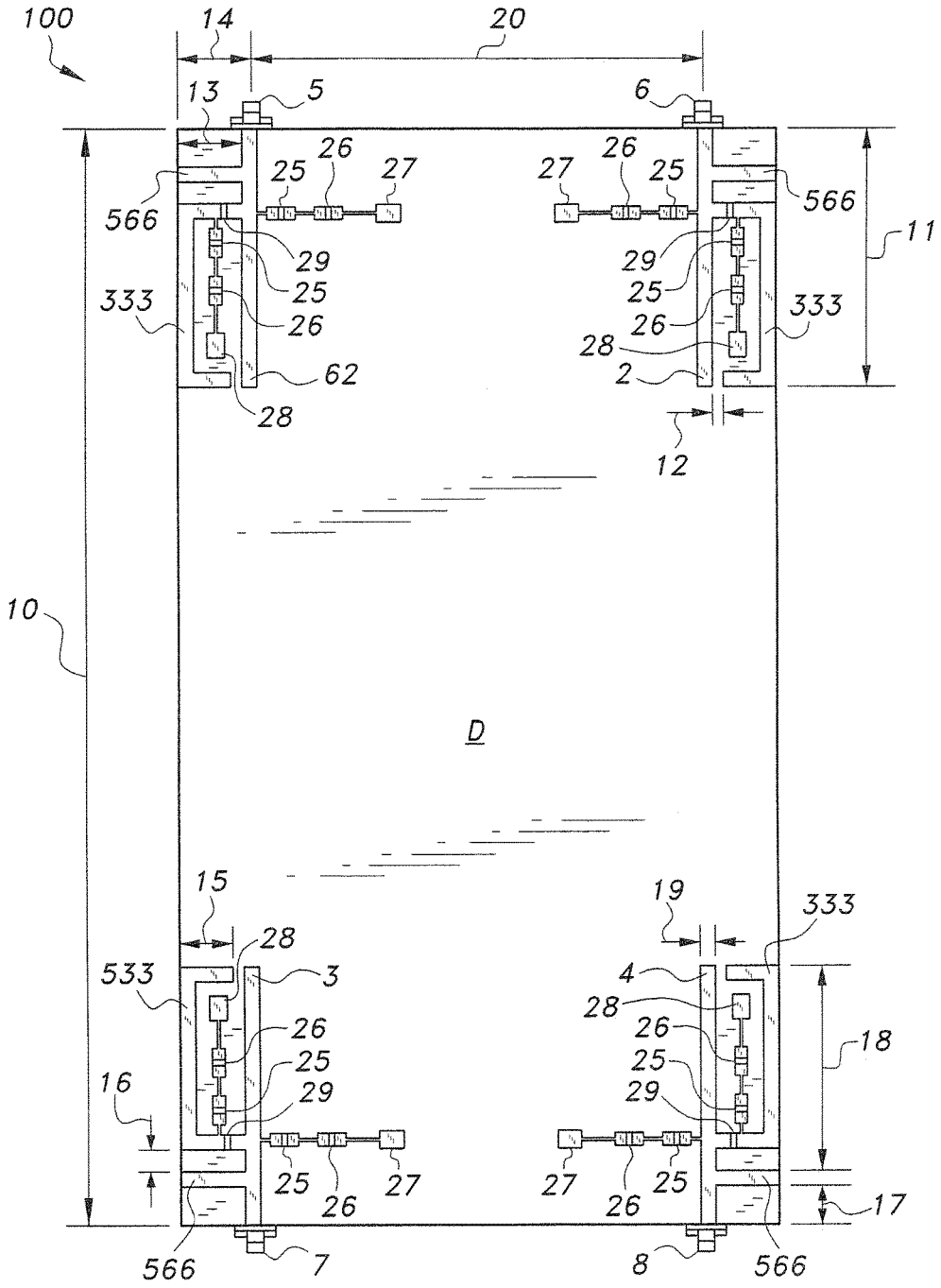
FIG. 1A is a top plan view of the circuit board of a wide band frequency agile MIMO antenna system according to the present invention.
Figure 1B:
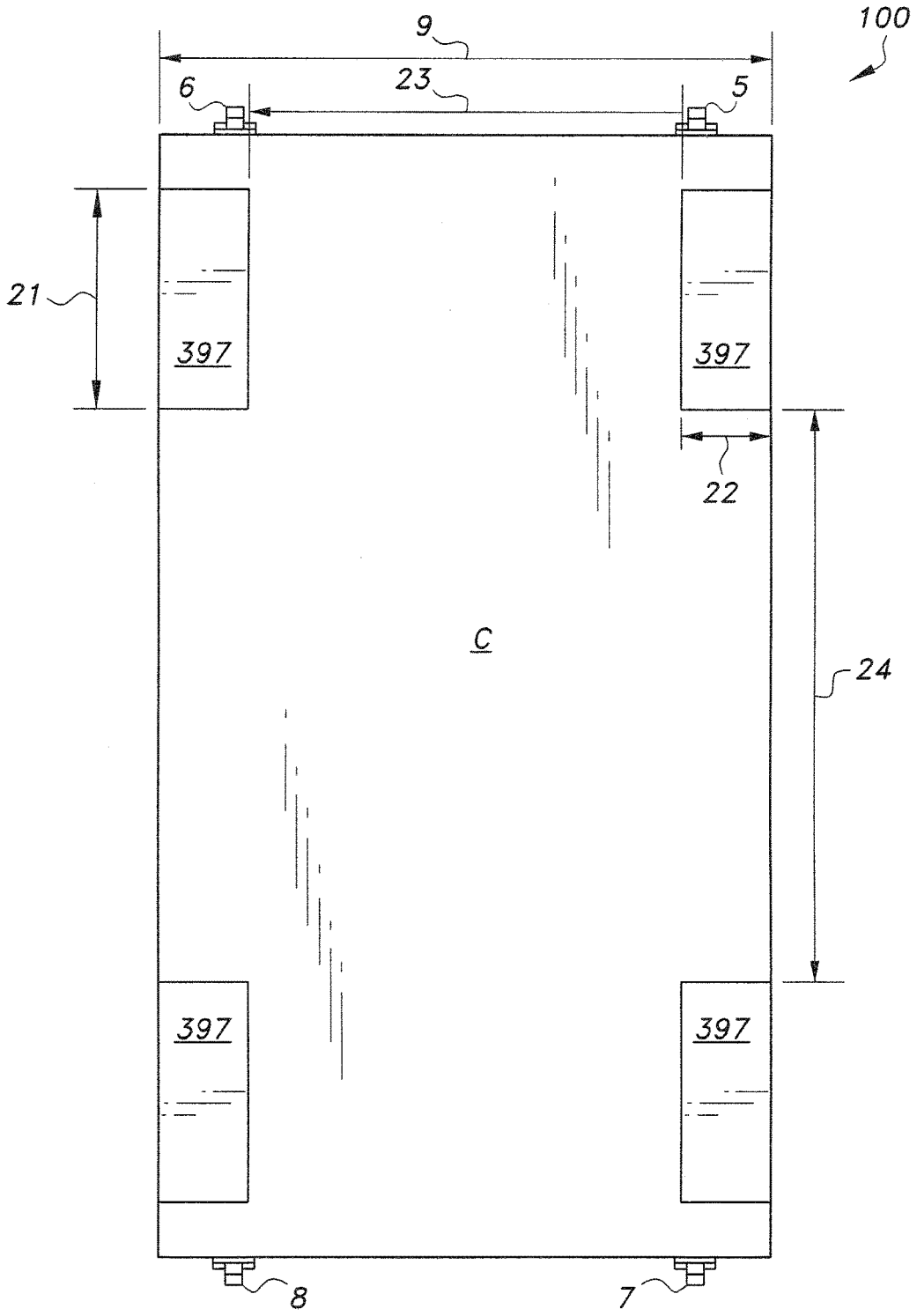
FIG. 1B is a bottom plan view of the circuit board of the wide band frequency agile MIMO antenna system of FIG. 1A.

FIGS. 1A and 1B show the top layer (face) D and bottom layer (face) C, respectively, of the circuit board of the wide-band frequency agile MIMO antenna system. The reconfigurable MIMO antennas are fabricated on a copper-clad dielectric substrate (e.g., a commercial FR-4 material) of height 0.8 mm. The rectangular printed circuit board has a width defined by dimension 9 (see FIG. 1B; preferably 60 mm) and a length defined by dimension 10 (see FIG. 1A; preferably 100 mm). The top layer D contains four symmetrical planar copper microstrip antenna elements (the balance of the board being the exposed dielectric substrate) based on a modified monopole reconfigurable MIMO antenna, having a top left monopole linear element 62 in the upper left corner or quadrant, a mirror image top right monopole linear element 2 in the upper right corner or quadrant, a bottom left monopole linear element 3 in the lower left corner or quadrant, and a mirror image bottom right monopole linear element 4 in the lower right corner or quadrant. Each monopole includes an eccentric channel-shaped (U-shaped) meander line 333 electrically connected to a stub extending from the linear element 62, 2, 3, 4 by a varactor diode 29 between the stub and the coaxial first or upper flange of the meander line 333. A portion (the web or bight) of the eccentric channel-shaped meander line 333 runs parallel to the monopole for a length 18 of approximately 19.1 mm along the lengthwise edge of the board. The monopole linear element length 11 is approximately 26.9 mm. The distance 13 from the monopole linear element to the board length edge is approximately 6.42 mm. The monopole's thickness 19 is approximately 1.48 mm.

An electrically connected extension bar 566 extends from the monopole's linear element between the board width edge and the electrically connected meander line 333, the electrically connected extension bar 566 running parallel to the board width edge and orthogonal to the monopole linear element, and having a space 16 between it and a parallel flange or leg of the meander line 333 of approximately 2.4 mm. The distance 17 between the electrically connected extension bar 566 and the board width edge is approximately 5.4 mm. There is a gap between the opposite flange or leg of the eccentric channel-shaped meander line 333 and the medial end of the monopole linear element (the end most distal from the board width edge). The gap dimension 12 is approximately 1.12 mm. The eccentric channel meander line 333 includes a flange or leg extending towards the gap 12 and having a length 15, which is approximately 5.3 mm.

A SubMiniature version A (SMA) coaxial connector 5 feeds monopole linear element 62 at the board width edge of the monopole linear element 62 to provide a system input to the monopole linear element 62. A SMA coaxial connector 6 feeds monopole linear element 2 at the board width edge of the monopole linear element 2 to provide a system input to monopole linear element 2. A SMA coaxial connector 7 feeds monopole linear element 3 at the board width edge of the monopole linear element 3 to provide a system input to monopole linear element 3. A SMA coaxial connector 8 feeds monopole linear element 4 at the board width edge of the monopole linear element 4 to provide a system input to monopole linear element 4. The distance 14 from the lengthwise edge of the board to the centerline of the SMA is approximately 7.16 mm. The distance 20 between the centerline of SMA connectors 5 and 6 is approximately 45.68 mm. As shown in FIG. 1B, the bottom layer C of the circuit board has a central copper ground plane with rectangular cutouts 397 underlying each of the four monopole antennas, the cutouts 397 exposing the dielectric substrate, each cutout 397 having a length 21 of approximately 23.4 mm and a width 22 of approximately 9 mm. The distance 23 between opposing cutouts 397 with respect to the width of the PC board is approximately 42 mm. The distance 24 between opposing cutouts 397 with respect to the length of the PC board is approximately 42.2 mm. The PC board has a thickness of approximately 0.8 mm and a substrate dielectric constant $\in_r$ of approximately 4.4.

Figure 3:
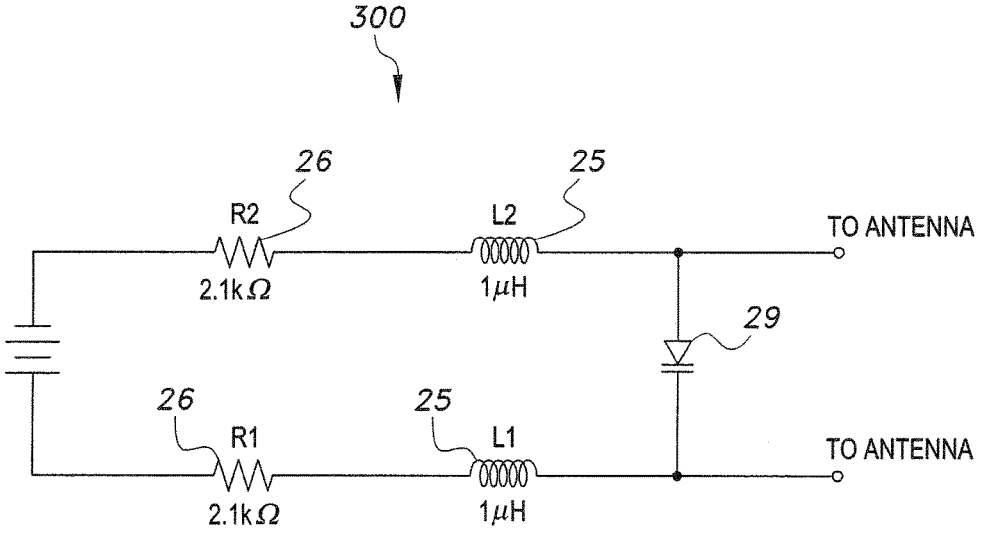
FIG. 3 is a schematic diagram of a varactor bias circuit for a wide band frequency agile MIMO antenna system according to the present invention.

Reconfigurability is achieved using varactor diodes. The varactor diode bias circuits are shown on the top layer D of the board. The varactor diodes 29, which are disposed between their respective stubs and eccentric channel-shaped meander lines 333, each have a bias circuit 300, as shown in FIG. 3. A 1 μH RF choke 25 connected to the meander 333 is disposed in series with a 2.1 kΩ resistor 26 that terminates at the digital reference ground (GND) pad 28, which is disposed near the gap 12 between the monopole and eccentric channel-shaped meander line 333. A variable +6V (VCC) is applied at pad 27, which connects to a 2.1 kΩ resistor 26 in series with a 1 μH RF choke 25 connected to the monopole linear element in-line or coaxially with the connection of channel-shaped meander line 333 to the monopole stub.

Figure 2B:
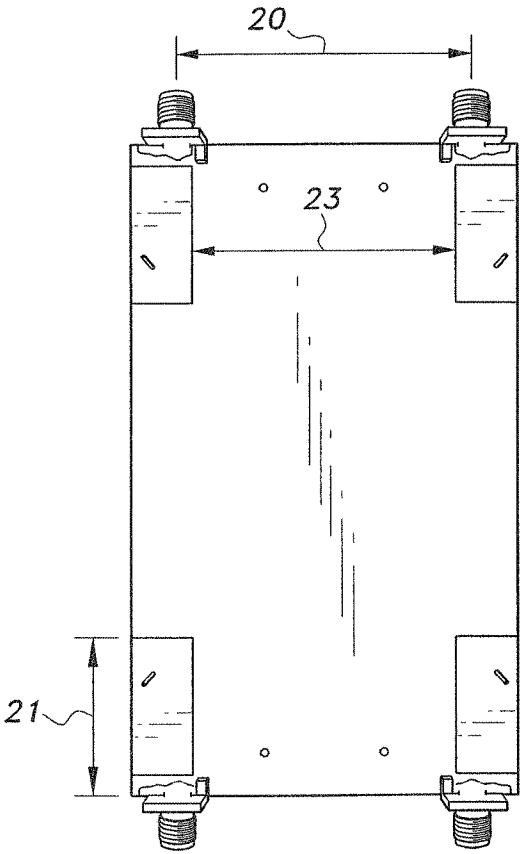
FIG. 2B is a bottom plan view of the wide band frequency agile MIMO antenna system of FIG. 2A.
Figure 2A:
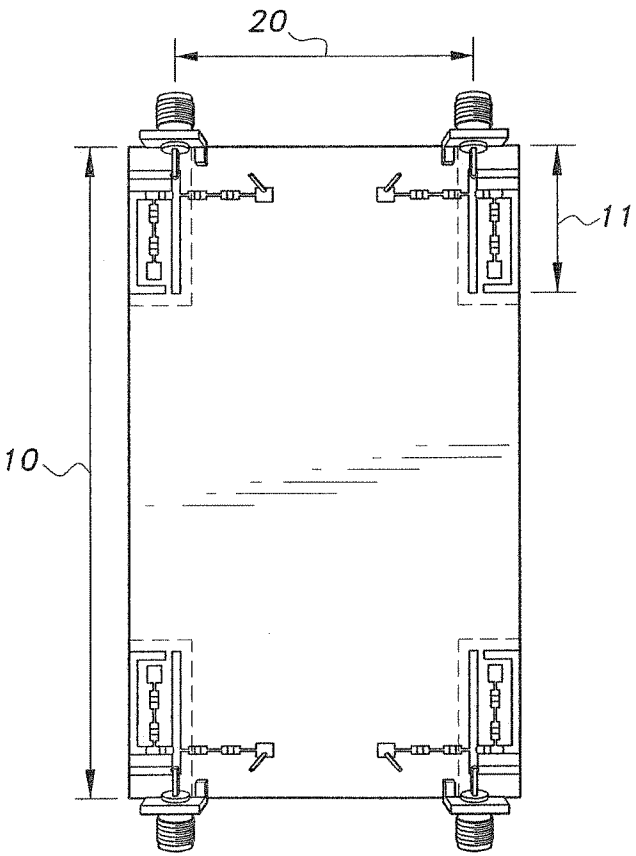
FIG. 2A is a top plan view of a wide band frequency agile MIMO antenna system according to the present invention, showing coax connectors mounted thereon.

A single varactor diode 29 is used by each antenna element, respectively, to load the antenna with various capacitances to achieve the frequency agility in the design. All antenna elements of a single design are exactly similar in structure. The linear elements 62, 2, 3, 4, the extension bars 566, the stubs, and the meander lines 333 are all planar copper strips formed by etching or removing the remaining copper cladding on the top face of the board. FIGS. 2A and 2B show the top and bottom view of the fabricated design, respectively. The complete schematic of biasing circuit 300 for the varactor diode 29 for a single antenna element is shown in FIG. 3.

Figure 4:
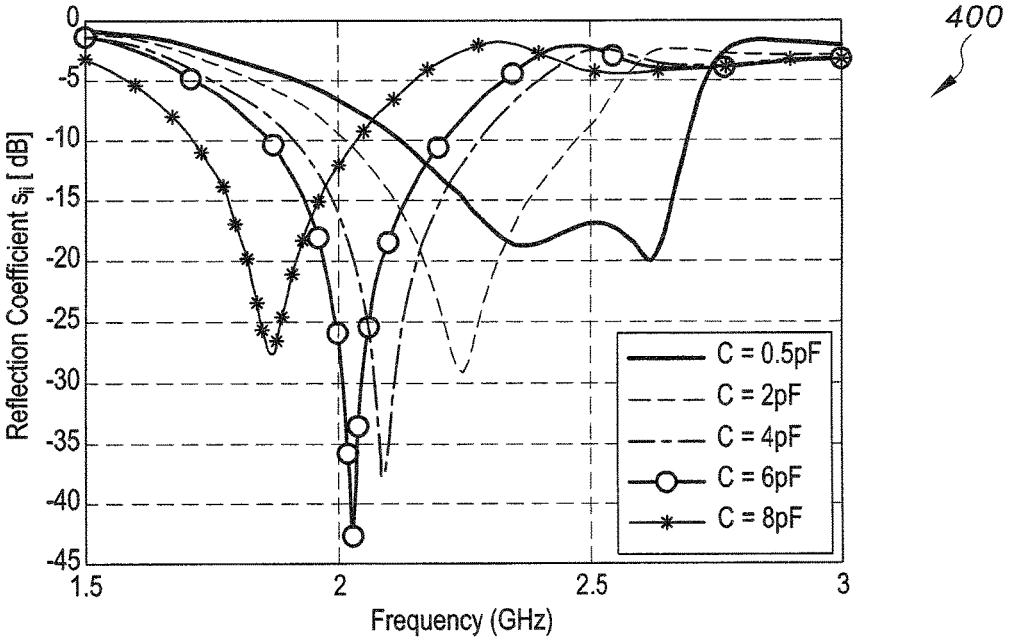
FIG. 4 is a plot of reflection coefficient vs. frequency for the wide band frequency agile MIMO antenna system according to the present invention for selected capacitance values
Figure 5:
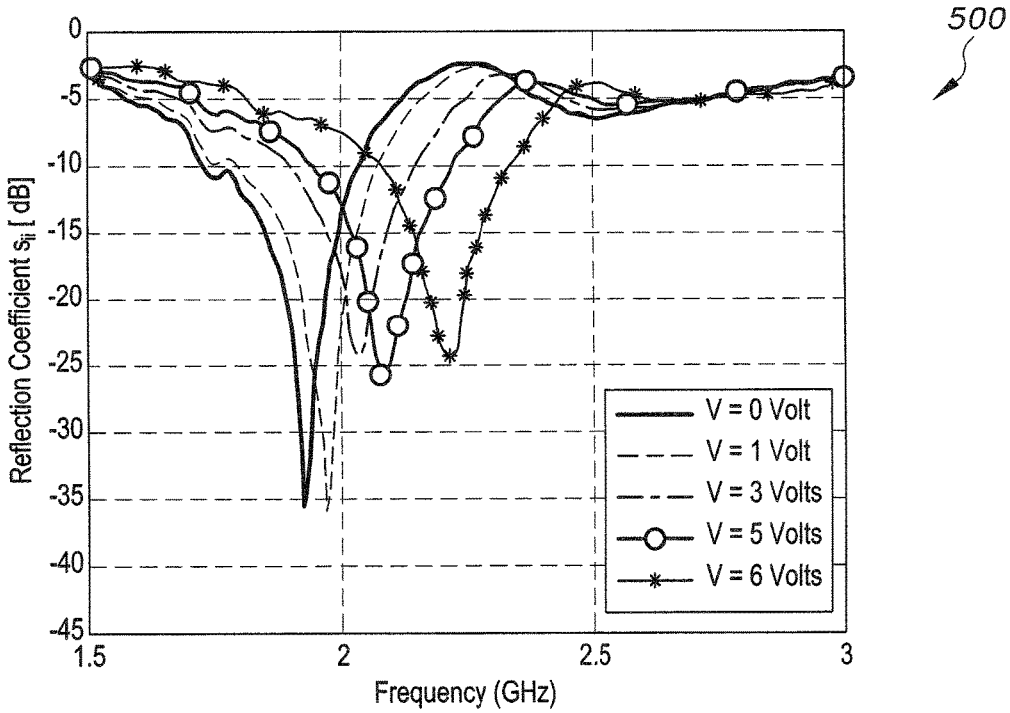
FIG. 5 is a plot of reflection coefficient vs. frequency for the wide band frequency agile MIMO antenna system according to the present invention for selected applied voltage values.
Figure 6:
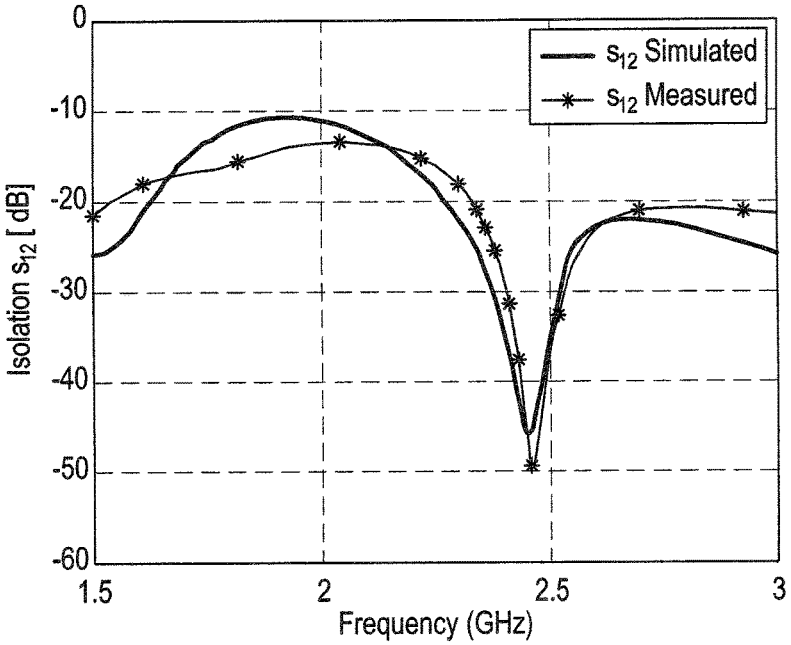
FIG. 6 is a plot of isolation ($s_{12}$) vs. frequency for the wide band frequency agile MIMO antenna system according to the present invention, comparing isolation for simulated and measured $s_{12}$ values.

For antenna operation, the reverse bias voltage applied to varactor diode 29 was varied between 0~6 volts. The capacitance of varactor diode 29 has a significant effect on its resonant frequency. The resonant frequency was smoothly changed over the frequency band 1610~2710 MHz. The capacitance of the diode 29 was varied from 0.5 pF to 8 pF. A significant bandwidth is achieved at all resonating bands. The minimum −6 dB operating bandwidth was 520 MHz. The simulated reflection coefficients are shown in plot 400 of FIG. 4 for selected values of the varactor capacitance. Measured reflection coefficients are shown in plot 500 of FIG. 5 for selected voltages applied to the varactor bias circuit 300. The simulated and measured isolation curves are shown in plot 600 of FIG. 6.

The 3D gain patterns of the present reconfigurable MIMO antenna system were computed using ANSYS® High Frequency Structure Simulator (HFSS). The gain patterns for four antenna elements at 2000 MHz reveal tilting that can provide enhanced MIMO features with its low correlation coefficient.

Figure 7:
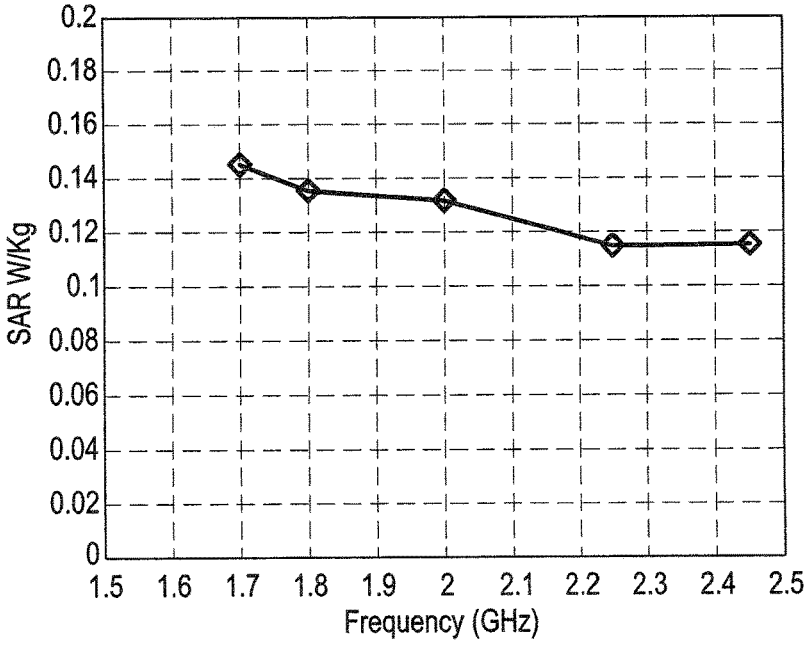
FIG. 7 is a plot of specific absorption rate (SAR) vs. frequency for the wide band frequency agile MIMO antenna system according to the present invention.

Specific absorption rate (SAR) is a measure of the rate at which energy is absorbed by the human body when exposed to a radio frequency (RF) electromagnetic field. It is amount of energy absorbed by human tissues. It is defined as the power absorbed per mass of tissue and has units of watts per kilogram (W/kg). The SAR values are computed for human head phantom and are plotted for the desired range of frequency band, as shown in plot 700 of FIG. 7. The SAR values calculated for the given MIMO antenna is lower than the FCC standard value of 1.6 W/Kg.

It is to be understood that the present invention is not limited to the embodiments described above, but encompasses any and all embodiments within the scope of the following claims.

We claim:

1. A wide band frequency agile MIMO antenna, comprising:

a rectangular printed circuit (PC) board having opposing widthwise edges, opposing lengthwise edges, a top face, and a bottom face, the board defining upper left and right quadrants and lower left and right quadrants;

first, second, third, and fourth modified monopole antennas, each of the four quadrants on the top face having one of the modified monopole antenna disposed therein, each of the modified monopole elements having:

a planar microstrip linear element extending from the quadrant's widthwise edge parallel to the lengthwise edges and medially into the board;

a planar microstrip extension bar extending orthogonally from the linear element to the quadrant's lengthwise edge of the board;

a planar microstrip stub extending orthogonally from the linear element;

a planar microstrip eccentric channel-shaped meander line having a web portion extending parallel to the linear element adjacent the quadrant's lengthwise edge, the web portion having first and second ends, a first flange extending orthogonally from the first end of the web portion substantially coaxially with and spaced apart from the stub, and a second flange extending orthogonally from the second end of the web portion and spaced apart from the linear element;

a varactor diode connecting the stub to the first flange of the meander line; and a varactor bias circuit for applying a bias voltage to the varactor diode;

a central ground plane disposed on the bottom face of the printed circuit board, the ground plane having rectangular cutouts exposing dielectric beneath each of the four monopole antennas so that the ground plane is absent below each of the four monopole antennas, except for a feed portion extending from the quadrant's widthwise edge to the extension bar;

wherein the monopole antennas are tunable by varying the voltage applied to the varactor diodes.

2. The wide band frequency agile MIMO antenna according to claim 1, wherein said varactor bias circuit comprises a VCC pad;

a ground pad;

a first series-connected resistor and inductor, a resistor lead of the series being connected to the VCC pad, an inductor lead of the series being connected to the linear element of the corresponding monopole antenna coaxial with the stub; and a second series connected resistor and inductor, a resistor lead of the series being connected to the ground pad, an inductor lead of the series being connected to the first flange of the eccentric channel-shaped meander line.

3. The wide band frequency agile MIMO antenna according to claim 1, wherein the MIMO antenna is resonant over the GSM-1800/GSM-1900, PCS (1850~1990 MHz) and UMTS (1885~2200 MHz), and LTE 1800/1900/2100/2300/2600 MHz bands.

4. The wide band frequency agile MIMO antenna according to claim 1, wherein the MIMO antenna has a −6 dB operating bandwidth of 520 MHz.

5. The wide band frequency agile MIMO antenna according to claim 1, wherein said varactor diode has a capacitance varying between 0.5 pF and 8 pF when the voltage applied by said varactor bias circuit is varied between 0 volts and 6 volts.

* * * * *